US012638237B2

(12) United States Patent
Vemulapalli et al.

(10) Patent No.: US 12,638,237 B2
(45) Date of Patent: May 26, 2026

(54) SYSTEMS AND PROCESSES FOR STATIONARY AND MOBILE NATURAL GAS LIQUEFACTION

(71) Applicant: NuBlu Innovations, LLC, Center, TX (US)

(72) Inventors: Ravi Sudhakar Vemulapalli, Katy, TX (US); Robert Meredith Harman, Jr., Sugar Grove, WV (US)

(73) Assignee: NuBlu Innovations, LLC, Center, TX (US)

( * ) Notice: Subject to any disclaimer, the term of this patent is extended or adjusted under 35 U.S.C. 154(b) by 0 days.

(21) Appl. No.: 18/493,626

(22) Filed: Oct. 24, 2023

(65) Prior Publication Data

US 2024/0053096 A1 Feb. 15, 2024

Related U.S. Application Data

(63) Continuation of application No. 17/168,427, filed on Feb. 5, 2021, now abandoned.

(51) Int. Cl.
*F25J 1/00* (2006.01)
*F25J 1/02* (2006.01)

(52) U.S. Cl.
CPC ..... *F25J 1/0022* (2013.01); *F25J 1/0055* (2013.01); *F25J 1/0057* (2013.01); *F25J 1/0218* (2013.01); *F25J 1/0275* (2013.01)

(58) Field of Classification Search
CPC ..... F25J 1/0022; F25J 1/0259; F25J 1/0275; F25J 1/0288; F25J 1/0284; F25J 2210/06;
(Continued)

(56) References Cited

U.S. PATENT DOCUMENTS 398,068 A 2/1889 McEwan
1,693,885 A 12/1928 Butterworth
(Continued)

FOREIGN PATENT DOCUMENTS

CA 2366079 6/2003
CA 2594500 A1 8/2006
(Continued)

OTHER PUBLICATIONS (Harman, Robert et al.) Co-Pending U.S. Appl. No. 14/796,006, filed Jul. 10, 2015, Specification, Claims, Figures.
(Continued)

*Primary Examiner* — Frantz F Jules
*Assistant Examiner* — Webeshet Mengesha
(74) *Attorney, Agent, or Firm* — New River Valley IP Law, P.C.; Michele L. Mayberry; Ashley M. Gates

(57) ABSTRACT

The disclosure describes processes which include cooling a natural gas product stream to a cryogenic liquid storage temperature by way of refrigeration streams which include a primary refrigeration stream, a secondary refrigeration stream, and a tertiary refrigeration stream in a refrigeration system. After leaving the refrigeration system, the pressure of each refrigeration stream is increased, and upon reaching a sufficient pressure, the refrigeration streams are recycled to flow back into the refrigeration system as a recycle stream. The disclosure further describes systems capable of performing the processes. The processes and systems can include one or more sensors and one or more controls capable of adjusting a flow rate, flow volume, and/or flow ratio among one or more gas streams to maximize cooling efficiency based on monitoring from the one or more sensors. Mobile natural gas liquefaction systems are also described.

15 Claims, 3 Drawing Sheets

(58) Field of Classification Search
CPC ..... F25J 2290/70; F25J 1/004; F25J 1/0215; F25J 1/0037; F25J 1/0294; F25J 1/0045; F25J 1/0055; F25J 1/0202; F25J 2240/90; F25J 2235/60
See application file for complete search history.

(56) References Cited

U.S. PATENT DOCUMENTS 1,838,634 A 12/1931 Peterson et al.
1,857,766 A 5/1932 Peterson
2,116,935 A 5/1938 Richard et al.
2,375,513 A 5/1945 Bach
2,845,091 A 7/1958 Neer
2,845,934 A 8/1958 Richard
2,858,836 A 11/1958 Geh et al.
2,964,512 A 12/1960 Goins
3,002,468 A 10/1961 Williams
3,022,792 A 2/1962 Perkins
3,046,163 A 7/1962 Kearney et al.
3,104,672 A 9/1963 Holdren
3,394,761 A 7/1968 Jackson, Jr. et al.
3,420,444 A 1/1969 Gunnar
3,556,407 A 1/1971 Hiroshi et al.
3,599,871 A 8/1971 Ruppel et al.
3,645,452 A 2/1972 Stoeckel et al.
3,741,808 A 6/1973 Stalker
3,746,023 A 7/1973 Smith
3,837,399 A 9/1974 Allen et al.
3,856,334 A 12/1974 Lange
4,106,950 A 8/1978 Grismer
4,144,901 A 3/1979 Stevenson
4,207,965 A 6/1980 Chiang-Cheng et al.
4,220,170 A 9/1980 Hebert et al.
4,232,738 A 11/1980 Yen et al.
4,244,523 A 1/1981 Looper
4,351,478 A 9/1982 Looper
4,413,785 A 11/1983 Engelbert et al.
4,453,864 A 6/1984 Beck et al.
4,557,636 A 12/1985 Beck et al.
4,574,825 A 3/1986 Haug
4,604,037 A 8/1986 Hoya
4,660,678 A 4/1987 Krag
4,668,358 A 5/1987 Ball
4,672,710 A 6/1987 Urbani
4,725,362 A 2/1988 Dugat
4,751,887 A 6/1988 Terry et al.
4,753,268 A 6/1988 Palau
4,890,673 A 1/1990 Payne
4,941,493 A 7/1990 Wieringa
4,942,929 A 7/1990 Malachosky et al.
4,957,188 A 9/1990 Bavis
4,994,169 A 2/1991 Godino et al.
5,033,490 A 7/1991 Wade et al.
5,048,775 A 9/1991 Hungerford
5,058,612 A 10/1991 Winsted
5,096,047 A 3/1992 Morikiyo et al.
5,107,879 A 4/1992 Harvey
5,109,933 A 5/1992 Jackson
5,129,469 A 7/1992 Jackson
5,195,548 A 3/1993 Roger
5,226,749 A 7/1993 Perkins
5,303,786 A 4/1994 Prestridge et al.
5,306,351 A 4/1994 Anderson
5,310,285 A 5/1994 Northcott
5,336,052 A 8/1994 Zollner et al.
5,337,966 A 8/1994 Francis et al.
5,344,570 A 9/1994 McLachlan et al.
5,352,298 A 10/1994 Moulder
5,361,998 A 11/1994 Sirevag et al.
5,402,857 A 4/1995 Dietzen
5,405,223 A 4/1995 Sirevag
5,419,496 A 5/1995 Novak
5,421,903 A 6/1995 Manabe et al.
5,426,137 A 6/1995 Allen
5,431,236 A 7/1995 Warren
5,454,662 A 10/1995 Skibitzke et al.
5,518,553 A 5/1996 Moulder
5,526,562 A 6/1996 Kita et al.
5,544,669 A 8/1996 Manabe et al.
5,564,509 A 10/1996 Dietzen
5,589,603 A 12/1996 Alexander et al.
5,638,845 A 6/1997 Oliver et al.
5,685,411 A 11/1997 Zimmerman et al.
5,718,382 A 2/1998 Jaeger
5,720,310 A 2/1998 Moulder
5,734,988 A 3/1998 Alexander et al.
5,740,821 A 4/1998 Arnold
5,839,521 A 11/1998 Dietzen
5,896,871 A 4/1999 Larsen
5,961,438 A 10/1999 Ballantine et al.
5,964,304 A 10/1999 Morrison et al.
6,009,959 A 1/2000 Dietzen
6,021,793 A 2/2000 Moulder
6,105,390 A 8/2000 Bingham et al.
6,106,733 A 8/2000 Wood
6,119,779 A 9/2000 Gipson et al.
6,179,070 B1 1/2001 Dietzen
6,179,071 B1 1/2001 Dietzen
6,189,613 B1 2/2001 Chachula et al.
6,192,905 B1 2/2001 Mincy et al.
6,213,134 B1 4/2001 Pike
6,213,135 B1 4/2001 Moulder
6,213,227 B1 4/2001 Dietzen
6,321,754 B1 11/2001 Manabe et al.
6,321,860 B1 11/2001 Reddoch
6,345,672 B1 2/2002 Dietzen
6,378,330 B1 * 4/2002 Minta ..... F25J 1/004 62/619
6,378,791 B1 4/2002 Perry et al.
6,425,263 B1 7/2002 Bingham et al.
6,435,565 B2 8/2002 Potts et al.
6,488,314 B1 12/2002 Hutter
6,491,173 B1 12/2002 Costa
6,553,901 B2 4/2003 Reddoch
6,564,578 B1 5/2003 Fischer-Calderon
6,581,409 B2 6/2003 Wilding et al.
6,585,115 B1 7/2003 Reddoch et al.
6,886,362 B2 5/2005 Wilding et al.
6,910,411 B2 6/2005 Reddoch
6,939,218 B1 9/2005 Holland
6,953,097 B2 10/2005 Seyffert
6,955,704 B1 10/2005 Strahan
6,962,060 B2 11/2005 Petrowski et al.
6,962,061 B2 11/2005 Wilding et al.
6,988,677 B2 1/2006 Sodemann et al.
6,994,464 B2 2/2006 Villwock et al.
7,089,949 B1 8/2006 Rogerson et al.
7,104,220 B1 9/2006 Mack et al.
7,108,143 B1 9/2006 Lin
7,127,914 B2 10/2006 Roberts et al.
7,219,512 B1 5/2007 Wilding et al.
7,261,109 B2 8/2007 Luke et al.
7,325,629 B2 2/2008 Blaschke et al.
7,455,066 B2 11/2008 Feddema et al.
7,478,975 B2 1/2009 Hubbard et al.
7,523,570 B2 4/2009 Pobihushchy
7,552,598 B2 6/2009 Paradowski
7,575,072 B2 8/2009 Reddoch
7,591,150 B2 9/2009 Turner et al.
7,594,414 B2 9/2009 Wilding et al.
7,637,122 B2 12/2009 Turner et al.
7,673,476 B2 3/2010 Whitesell
7,717,474 B2 5/2010 Gray
7,798,218 B2 9/2010 Garstad et al.
7,857,077 B2 12/2010 Reddoch
7,905,683 B2 3/2011 Kearney
8,061,413 B2 11/2011 Turner et al.
8,133,164 B2 3/2012 Beebe et al.
8,133,328 B2 3/2012 Delaney et al.
8,137,030 B2 3/2012 Kearney
8,316,557 B2 11/2012 Burnett
8,316,963 B2 11/2012 Eia et al.
8,398,034 B2 3/2013 Lambert et al.
8,424,784 B1 4/2013 Munisteri

(56) References Cited

U.S. PATENT DOCUMENTS

| | | | | |
|---|---|---|---|---|
| 8,464,971 | B1 | 6/2013 | Munisteri | |
| 8,470,139 | B2 | 6/2013 | Booth | |
| 8,533,974 | B2 | 9/2013 | Burnett | |
| 8,544,295 | B2 | 10/2013 | Turner et al. | |
| 8,555,672 | B2 | 10/2013 | Turner et al. | |
| 8,584,749 | B2 | 11/2013 | Troshko et al. | |
| 8,607,894 | B2 | 12/2013 | McDonald et al. | |
| 8,757,320 | B2 | 6/2014 | Liao | |
| 8,899,074 | B2 | 12/2014 | Wilding et al. | |
| 9,204,774 | B1 | 12/2015 | Jackson | |
| 9,217,603 | B2 | 12/2015 | Turner et al. | |
| 9,254,448 | B2 | 2/2016 | Turner et al. | |
| 9,440,239 | B1 | 9/2016 | Horton et al. | |
| 9,574,713 | B2 | 2/2017 | Turner et al. | |
| 9,938,784 | B2 | 4/2018 | Song et al. | |
| 10,000,704 | B2 | 6/2018 | Young et al. | |
| 10,544,986 | B2 | 1/2020 | Wehrman et al. | |
| 10,589,287 | B2 | 3/2020 | Harman et al. | |
| 10,788,259 | B1 * | 9/2020 | Tomlinson | F25J 1/0045 |
| 11,008,821 | B1 | 5/2021 | Steger et al. | |
| 2002/0134554 | A1 | 9/2002 | Schrenkel et al. | |
| 2003/0135083 | A1 | 7/2003 | Bruno et al. | |
| 2003/0165390 | A1 | 9/2003 | Jahn et al. | |
| 2003/0192439 | A1 | 10/2003 | Reddoch | |
| 2003/0223850 | A1 | 12/2003 | Hendriks et al. | |
| 2005/0077299 | A1 | 4/2005 | Cheng et al. | |
| 2005/0199269 | A1 | 9/2005 | Heil et al. | |
| 2005/0229954 | A1 | 10/2005 | Rosselott et al. | |
| 2006/0016760 | A1 | 1/2006 | Bozak et al. | |
| 2006/0065292 | A1 | 3/2006 | Moore | |
| 2007/0107465 | A1 | 5/2007 | Turner et al. | |
| 2007/0120665 | A1 | 5/2007 | Martin et al. | |
| 2007/0215346 | A1 | 9/2007 | Sloan et al. | |
| 2008/0006053 | A1 | 1/2008 | Bauer et al. | |
| 2008/0013401 | A1 | 1/2008 | Tarmann et al. | |
| 2008/0083566 | A1 | 4/2008 | Burnett | |
| 2008/0129039 | A1 | 6/2008 | Gray | |
| 2008/0165612 | A1 | 7/2008 | Dykstra | |
| 2008/0283295 | A1 | 11/2008 | Eia | |
| 2008/0283301 | A1 | 11/2008 | Sherwood et al. | |
| 2009/0078647 | A1 | 3/2009 | Frazier et al. | |
| 2009/0087319 | A1 | 4/2009 | Russold et al. | |
| 2009/0145167 | A1 | 6/2009 | Turner et al. | |
| 2009/0194280 | A1 | 8/2009 | Gil et al. | |
| 2009/0227477 | A1 | 9/2009 | Burnett | |
| 2010/0025497 | A1 | 2/2010 | Ellenbecker | |
| 2010/0040439 | A1 | 2/2010 | Temple et al. | |
| 2010/0051263 | A1 | 3/2010 | Daniel et al. | |
| 2010/0122551 | A1 | 5/2010 | Roberts et al. | |
| 2010/0129155 | A1 | 5/2010 | Kearney | |
| 2010/0154828 | A1 | 6/2010 | Green | |
| 2010/0186446 | A1 | 7/2010 | Turner et al. | |
| 2010/0236580 | A1 | 9/2010 | Delaurentiis | |
| 2010/0288708 | A1 | 11/2010 | Sloan et al. | |
| 2010/0301147 | A1 | 12/2010 | Harkess et al. | |
| 2011/0005832 | A1 | 1/2011 | McDonald et al. | |
| 2011/0047743 | A1 | 3/2011 | Shepherd | |
| 2011/0094261 | A1 | 4/2011 | Wilding et al. | |
| 2011/0094262 | A1 | 4/2011 | Turner et al. | |
| 2011/0094263 | A1 | 4/2011 | Wilding et al. | |
| 2011/0114138 | A1 | 5/2011 | Bastuji et al. | |
| 2011/0246162 | A1 | 10/2011 | Brown et al. | |
| 2011/0284031 | A1 | 11/2011 | Green | |
| 2012/0000495 | A1 | 1/2012 | Schmit et al. | |
| 2012/0103012 | A1 | 5/2012 | Turner et al. | |
| 2012/0103428 | A1 | 5/2012 | Turner et al. | |
| 2012/0103561 | A1 | 5/2012 | Turner et al. | |
| 2012/0186491 | A1 | 7/2012 | Cuypers et al. | |
| 2012/0260945 | A1 | 10/2012 | Kim et al. | |
| 2013/0048575 | A1 | 2/2013 | Gruber et al. | |
| 2013/0057132 | A1 | 3/2013 | Flowers et al. | |
| 2013/0067762 | A1 | 3/2013 | Burnett | |
| 2013/0160989 | A1 | 6/2013 | Durden | |
| 2013/0213674 | A1 | 8/2013 | Williams et al. | |
| 2013/0213893 | A1 | 8/2013 | Posa | |
| 2013/0247939 | A1 | 9/2013 | Chanthavongsy et al. | |
| 2013/0263624 | A1 | 10/2013 | Vandor | |
| 2013/0340475 | A1 | 12/2013 | Turner et al. | |
| 2014/0083132 | A1 | 3/2014 | Maunder et al. | |
| 2014/0190517 | A1 | 7/2014 | Fallon et al. | |
| 2014/0318178 | A1 | 10/2014 | Campo | |
| 2015/0192115 | A1 | 7/2015 | Seith et al. | |
| 2016/0290334 | A1 | 10/2016 | Overend et al. | |
| 2016/0331518 | A1 | 11/2016 | Cable, II et al. | |
| 2017/0009557 | A1 | 1/2017 | Harman et al. | |
| 2017/0152728 | A1 | 6/2017 | Abou-Sayed et al. | |
| 2017/0167788 | A1 * | 6/2017 | Pierre, Jr. | F25J 1/0283 |
| 2017/0254177 | A1 | 9/2017 | Woodford et al. | |
| 2017/0274333 | A1 | 9/2017 | Smith | |
| 2017/0335660 | A1 | 11/2017 | Blackwell et al. | |
| 2018/0028946 | A1 | 2/2018 | Tabata et al. | |
| 2018/0038639 | A1 | 2/2018 | Farges et al. | |
| 2018/0058992 | A1 | 3/2018 | Oort et al. | |
| 2018/0128251 | A1 | 5/2018 | Smith et al. | |
| 2018/0209728 | A1 | 7/2018 | Turisci et al. | |
| 2018/0231303 | A1 * | 8/2018 | Pierre, Jr. | F25J 1/0278 |
| 2019/0049174 | A1 * | 2/2019 | Groenendijk | F25J 1/0042 |
| 2020/0033054 | A1 * | 1/2020 | Jager | F25J 1/0271 |
| 2020/0200471 | A1 | 6/2020 | Brussol et al. | |
| 2020/0370988 | A1 | 11/2020 | Rogers et al. | |
| 2021/0040803 | A1 | 2/2021 | Collins | |
| 2021/0088273 | A1 | 3/2021 | Harman, Jr. et al. | |
| 2021/0180615 | A1 | 6/2021 | Hove | |
| 2021/0308637 | A1 | 10/2021 | Harman, Jr. et al. | |
| 2021/0310334 | A1 | 10/2021 | Harman, Jr. et al. | |
| 2022/0088552 | A1 | 3/2022 | McConville et al. | |
| 2022/0112789 | A1 | 4/2022 | Harman, Jr. et al. | |
| 2022/0136489 | A1 | 5/2022 | Fisher et al. | |
| 2022/0252340 | A1 | 8/2022 | Vemulapalli et al. | |
| 2023/0366619 | A1 | 11/2023 | Vemulapalli et al. | |

FOREIGN PATENT DOCUMENTS

| | | | |
|---|---|---|---|
| CA | 2937235 | C | 6/2018 |
| CN | 2350522 | | 11/1999 |
| CN | 201125043 | | 10/2008 |
| CN | 201711322 | U | 1/2011 |
| CN | 201728211 | U | 2/2011 |
| CN | 201915073 | U | 8/2011 |
| CN | 202162184 | U | 3/2012 |
| CN | 202199558 | U | 4/2012 |
| CN | 103215093 | B | 6/2014 |
| CN | 104807287 | A | 7/2015 |
| CN | 105233744 | A | 1/2016 |
| CN | 205300110 | U | 6/2016 |
| CN | 106524666 | A | 3/2017 |
| CN | 206146101 | U | 5/2017 |
| CN | 208108613 | U | 11/2018 |
| EP | 0041855 | A1 | 12/1981 |
| EP | 1437184 | B1 | 8/2012 |
| EP | 1686883 | B1 | 11/2012 |
| EP | 2512958 | B1 | 5/2013 |
| FR | 3022901 | B1 | 7/2016 |
| JP | 2019210861 | A | 12/2019 |
| KR | 20040037631 | A | 5/2004 |
| KR | 20160143035 | A | 12/2016 |
| KR | 20170001334 | A | 1/2017 |
| RU | 2412410 | C1 | 2/2011 |
| RU | 2644605 | C2 | 2/2018 |
| WO | 1991016150 | A1 | 10/1991 |
| WO | 1993018864 | A1 | 9/1993 |
| WO | 1994017922 | A1 | 8/1994 |
| WO | 1995014543 | A1 | 6/1995 |
| WO | 1995022415 | A1 | 8/1995 |
| WO | 1997000142 | A1 | 1/1997 |
| WO | 1998016717 | A1 | 4/1998 |
| WO | 1999004134 | A1 | 1/1999 |
| WO | 2002005682 | A2 | 1/2002 |
| WO | 2002044515 | A1 | 6/2002 |
| WO | 2003059540 | A1 | 7/2003 |
| WO | 2008000103 | A1 | 1/2008 |
| WO | 2008041020 | A1 | 4/2008 |
| WO | 2008113070 | A2 | 9/2008 |
| WO | 2009050178 | A2 | 4/2009 |

(56) References Cited

FOREIGN PATENT DOCUMENTS

| | | | |
|---|---|---|---|
| WO | 2010143060 | A1 | 12/2010 |
| WO | 2012005889 | A1 | 1/2012 |
| WO | 2012082216 | A1 | 6/2012 |
| WO | 2013048252 | A2 | 4/2013 |
| WO | 2014023476 | A1 | 2/2014 |

OTHER PUBLICATIONS (Harman, Robert et al.) Co-Pending U.S. Appl. No. 14/796,043, filed Jul. 10, 2015, Specification, Claims, Figures.
(Harman, Robert et al.) Co-pending U.S. Appl. No. 14/796,073, filed Jul. 10, 2015, Specification, Claims, Figures.
(Harman, Robert et al.) Co-Pending U.S. Appl. No. 15/214,550, filed Jul. 20, 2016, Specification, Claims, Figures.
(Harman, Robert et al.) Co-pending U.S. Appl. No. 16/580,571, filed Sep. 24, 2019, Specification, Claims, and Figures.
(Harman, Robert et al.) Co-pending U.S. Appl. No. 16/839,366, filed Apr. 3, 2020, Specification, Claims, and Figures.
(Harman, Robert et al.) Co-pending U.S. Appl. No. 16/839,390, filed Apr. 3, 2020, Specification, Claims, and Figures.
(Harman, Robert et al.) Co-pending U.S. Appl. No. 17/518,694, filed Nov. 4, 2021, Specification, Claims, and Figures.
(Harman, Robert et al.) Co-pending U.S. Appl. No. 18/398,897, filed Dec. 28, 2023, Specification, Claims, and Figures.
(Vemulapalli, Ravi et al.) Co-Pending U.S. Appl. No. 17/168,427, filed Feb. 5, 2021, Specification, Claims, and Figures.
(Vemulapalli, Ravi et al.) Co-Pending U.S. Appl. No. 18/315,233, filed May 10, 2023, Specification, Claims, and Figures.
Co-pending U.S. Appl. No. 16/580,571, Final Office Action dated Jun. 28, 2023, 12 pages.
Co-pending U.S. Appl. No. 16/580,571, Non-Final Office Action dated Aug. 12, 2022, 14 pages.
Co-pending U.S. Appl. No. 16/580,571, Notice of Non-Compliant Amendment dated Mar. 3, 2023, 3 pages.
Co-pending U.S. Appl. No. 16/580,571, Response to Aug. 12, 2022 Non-Final Office Action, dated Feb. 13, 2023, 14 pages.
Co-pending U.S. Appl. No. 16/580,571, Response to Dec. 17, 2021 Restriction Requirement, dated Jun. 17, 2022, 12 pages.
Co-pending U.S. Appl. No. 16/580,571, Response to Mar. 3, 2023 Notice of Non-Compliant Amendment, dated Mar. 14, 2023, 6 pages.
Co-pending U.S. Appl. No. 16/580,571, Restriction Requirement dated Dec. 17, 2021, 8 pages.
Co-pending U.S. Appl. No. 16/839,366, Final Office Action, dated May 17, 2022, 17 pages.
Co-pending U.S. Appl. No. 16/839,366, Non-Final Office Action, dated Dec. 12, 2022, 22 pages.
Co-pending U.S. Appl. No. 16/839,366, Non-Final Office Action, dated Nov. 12, 2021, 12 pages.
Co-pending U.S. Appl. No. 16/839,366, Non-Final Office Action, dated Nov. 4, 2021, 12 pages.
Co-pending U.S. Appl. No. 16/839,366, Notice of Allowance dated Sep. 21, 2023, 9 pages.
Co-pending U.S. Appl. No. 16/839,366, Response to Dec. 12, 2022 Non-Final Office Action, dated Jun. 12, 2023, 12 pages.
Co-pending U.S. Appl. No. 16/839,366, Response to Final Office Action, dated Nov. 15, 2022, 9 pages.
Co-pending U.S. Appl. No. 16/839,366, Response to Nov. 12, 2021 Non-Final Office Action, dated Mar. 14, 2022, 11 pages.
Co-pending U.S. Appl. No. 16/839,390, Final Office Action dated Apr. 19, 2023, 20 pages.
Co-pending U.S. Appl. No. 16/839,390, Non-Final Office Action dated Jul. 29, 2022, 19 pages.
Co-pending U.S. Appl. No. 16/839,390, Non-Final Office Action dated Nov. 20, 2023, 19 pages.
Co-pending U.S. Appl. No. 16/839,390, Response to Apr. 19, 2023 Final Office Action, dated Oct. 19, 2023, 9 pages.
Co-pending U.S. Appl. No. 16/839,390, Response to Jul. 29, 2022 Non-Final Office Action, dated Jan. 30, 2023, 8 pages.
Co-Pending U.S. Appl. No. 17/168,427, Non-Final Office Action dated Jan. 9, 2023, 10 pages.
Co-Pending U.S. Appl. No. 17/168,427, Notice Regarding Non-Compliant or Non-Responsive Amendment dated Aug. 24, 2023, 5 pages.
Co-Pending U.S. Appl. No. 17/168,427, Response to Aug. 26, 2022 Restriction Requirement, dated Nov. 28, 2022, 2 pages.
Co-Pending U.S. Appl. No. 17/168,427, Response to Jan. 9, 2023 Non-Final Office Action, dated Jul. 10, 2023, 10 pages.
Co-Pending U.S. Appl. No. 17/168,427, Restriction Requirement dated Aug. 26, 2022, 9 pages.
Co-pending U.S. Appl. No. 17/518,694, Non-Final Office Action dated Sep. 8, 2022, 14 pages.
Neff, Jerry Michael and Randi Elisabet Hagemann. "Environmental challenges of heavy crude oils: Management of liquid wastes" E&P Environmental and Safety Conference, OnePetro, 2007, 10 pages.

* cited by examiner

SYSTEMS AND PROCESSES FOR STATIONARY AND MOBILE NATURAL GAS LIQUEFACTION

CROSS-REFERENCE TO RELATED APPLICATIONS

The present application is a Continuation application of U.S. patent application Ser. No. 17/168,427 filed Feb. 5, 2021, the disclosure of which is hereby incorporated by reference in its entirety.

BACKGROUND

The present disclosure is directed to the field of natural gas processing, liquefaction. and storage.

SUMMARY

As described herein, one implementation of the disclosure is a process which includes cooling a natural gas product stream to a cryogenic liquid storage temperature by way of refrigeration streams which include a primary refrigeration stream, a secondary refrigeration stream, and a tertiary refrigeration stream in a refrigeration system, after leaving the refrigeration system, increasing the pressure of each refrigeration stream, and upon reaching a sufficient pressure, recycling the refrigeration streams to flow back into the refrigeration system as a compressed input or recycle stream.

Other process implementations including the preceding implementation can include splitting the compressed input or recycle stream to form a first stream which provides the primary refrigeration stream and a second stream which provides the natural gas product stream, the secondary refrigeration stream, and the tertiary refrigeration stream.

Other process implementations including any preceding implementation can include monitoring one or more gas characteristics and adjusting a flow rate, flow volume, and/or flow ratio within and/or among one or more of the first stream, the second stream, the natural gas product stream, the primary refrigeration stream, the secondary refrigeration stream, and/or the tertiary refrigeration stream based on the monitoring. The gas characteristics can be selected from a flow rate, a flow volume, a gas temperature, a gas composition, and a gas pressure.

Other process implementations including any preceding implementation can include directing the first stream through a turbo-expander to form the primary refrigeration stream.

Other process implementations including any preceding implementation can include directing the primary refrigeration stream, the secondary refrigeration stream, and the tertiary refrigeration stream to flow counter-currently to the product stream within the refrigeration system. The refrigeration system can comprise a primary heat exchanger, such as a single heat exchanger, such as a braised aluminum heat exchanger (BAHX), or a combination of multiple heat exchangers, such as one or more multiple passage braised aluminum heat exchanger.

Other process implementations including any preceding implementation can include accepting a first incoming gas at a first pressure such as by way of a first inlet and/or a second incoming gas at a second pressure such as by way of a second inlet and/or a third incoming gas at a third pressure such as by way of a third inlet, where the third pressure is higher than the second pressure and the second pressure is higher than the first pressure. In embodiments, a first inlet is capable of receiving incoming gas at a pressure of about less than 50 psi, a second inlet is capable of receiving incoming gas at a pressure of about 100 psi, such as from about 50 psi up to 300 psi, and a third inlet is capable of receiving incoming gas at a pressure of about 300 psi, such as from above 100 psi to about 300 psi or higher.

Other process implementations including any preceding implementation can include, after leaving the refrigeration system, mixing one or more of the refrigeration streams with the first incoming gas, the second incoming gas, or the third incoming gas before increasing the pressure of each refrigeration stream.

Other process implementations including any preceding implementation can include increasing the pressure of each refrigeration stream within a single multistage compressor which includes a first stage, a second stage, and a common motor driving each stage. The first stage can accept the first incoming gas and the second stage can accept compressed gas leaving the first stage as well as the second incoming gas. The single multistage compressor can include a third stage or additional stages driven by the common motor.

Other process implementations including any preceding implementation can include increasing the pressure of each refrigeration stream within a system of compressors which include a first compressor and a second compressor. The first compressor can accept the first incoming gas and the second compressor can accept compressed gas leaving the first compressor and the second incoming gas. The system of compressors can include three compressors or any number of additional compressors. The system of compressors can be a 3-stage compressor, for example, with all three compressors sharing the same shaft. The system can comprise a first compressor on a single shaft and two additional compressors sharing a second single shaft, or a first compressor comprising first and second compression stages sharing a first shaft, and a second compressor comprising a third compression stage on a second shaft.

Other process implementations including any preceding implementation can include expanding, decreasing the pressure, and/or further cooling the natural gas product stream by way of one or more Joule-Thompson valves to form a liquefied natural gas product, the secondary refrigeration stream, and the tertiary refrigeration stream.

Other process implementations including any preceding implementation can include, upon the product stream leaving the refrigeration system, separating a liquid phase and a gas phase of the product stream, where the liquid phase is supplied back to the refrigeration system to form the secondary refrigeration stream. The liquid phase and the gas phase can be separated in a separation vessel, with the liquid phase supplied back to the refrigeration system by way of a positive displacement pump. A motor of the positive displacement pump can be controlled with a variable frequency electrical drive to control a flow rate and/or volume of the secondary refrigeration stream.

Other process implementations including any preceding implementation can include performing the process on a mobile unit and receiving cleaned natural gas and power from one or more additional mobile units.

Another implementation of the disclosure is a system capable of performing any of the process implementations described herein.

One system implementation includes a refrigeration system designed to cool a natural gas product stream to a cryogenic liquid storage temperature by way of a plurality of refrigeration streams flowing optionally concurrently to the product stream, a compressor or a compressor system designed to increase pressures of the plurality of refrigeration streams upon exit from the refrigeration system to form a compressed input or recycle stream, and one or more conduit configured to transfer the plurality of refrigeration streams to the compressor or compressor system and transfer the compressed input or recycle stream to the refrigeration system.

Other system implementations including any preceding implementation can include a refrigeration system which is a heat exchanger designed to accommodate individual flows of up to five separate gas streams therethrough (i.e. five pass heat exchanger). The heat exchanger can be a braised aluminum heat exchanger (BAHX), such as a single heat exchanger or multiple heat exchangers, such as one or more multiple passage braised aluminum heat exchanger.

Other system implementations including any preceding implementation can include a compressor which is a single multistage compressor which includes a first stage, a second stage, and a common motor driving cach stage. The single multistage compressor can include a third compressor stage or any number of additional compressor stages driven by the common motor.

Other system implementations including any preceding implementation can include a system of compressors which include at least a first compressor and a second compressor. The system of compressors can include a third compressor or any number of additional compressors. In embodiments, the compressors of the system can be standalone compressors, meaning they do not share a common shaft but have their own individual shafts. The system of compressors can be arranged in series to incrementally compress one or more inputted gasses.

Other system implementations including any preceding implementation can include a first inlet and a second inlet in fluid communication with the compressor or compressor system, where the first inlet is configured to accept a first incoming gas stream at a first pressure, and the second inlet is configured to accept a second incoming gas stream at a second pressure higher than the first pressure. The system can further include one or more mixer designed to combine the first incoming gas stream and/or the second incoming gas stream with one or more of the refrigeration streams exiting the refrigeration system to provide one or more combined gas streams to the compressor or compressor system.

Other system implementations including any preceding implementation can include a turbo expander-compressor in fluid communication with the refrigeration system and the compressor or compressor system.

Other system implementations including any preceding implementation can include a storage in fluid communication with the refrigeration system and designed to accept incoming natural gas, to store a liquid phase of the incoming natural gas, and to output a boil off gas phase of the stored natural gas.

Other system implementations including any preceding implementation can include a separation vessel designed to separate a gas phase from a liquid phase, and a positive displacement pump configured to supply the liquid phase to the refrigeration system. A variable frequency electric drive can be configured to be in operable communication with and control a rate of a motor of the positive displacement pump.

Other system implementations including any preceding implementation can be housed on a mobile unit and can be designed to receive cleaned natural gas and power from one or more additional mobile units.

Another implementation of the disclosure is a mobile natural gas liquefaction system. The mobile natural gas liquefaction system can include a first mobile unit housing gas liquefaction equipment, a second mobile unit housing gas cleanup equipment, and a third mobile unit housing electrical power equipment. The second mobile unit is capable of a fluid communication with the first mobile unit and/or third mobile unit which allows transfer of a gas supply thereto. The third mobile unit is capable of an operative electrical connection with the first mobile unit and/or second mobile unit which allows transfer of an electrical power supply thereto.

In other mobile natural gas liquefaction system implementations including the preceding implementation, the gas liquefaction equipment is capable of performing any process implementation described herein.

In other mobile natural gas liquefaction system implementations including any preceding implementation, the gas liquefaction equipment is capable of liquefaction of cleaned natural gas supplied from the second mobile unit.

In other mobile natural gas liquefaction system implementations including any preceding implementation, the electrical power equipment includes an electrical generator capable of using cleaned natural gas supplied from the second mobile unit as fuel.

In other mobile natural gas liquefaction system implementations including any preceding implementation, the electrical power supply is capable of powering the gas liquefaction equipment and/or the gas cleanup equipment.

In other mobile natural gas liquefaction system implementations including any preceding implementation, the second mobile unit includes an input designed to receive raw natural feed gas to supply the gas cleanup equipment and one or more output capable of supplying cleaned natural gas to the first mobile unit and/or third mobile unit.

In other mobile natural gas liquefaction system implementations including any preceding implementation, the gas cleanup equipment is designed to remove one or more contaminants or impurities, including but not limited to water ($H_2O$), heavy hydrocarbons (such as C6+ hydrocarbons), BTEX, Mercaptans, mercury (Hg), $H_2S$ (hydrogen sulfide), and/or carbon dioxide ($CO_2$) from the raw natural feed gas. In embodiments, any or all impurities that may negatively impact the process can be removed.

In other mobile natural gas liquefaction system implementations including any preceding implementation, the first mobile unit, the second mobile unit, and the third mobile unit are independently chosen from trailers, skids or sea containers. In embodiments, any one or more of the mobile units can be any portable or transportable housing or container, such as an ISO (International Organization for Standardization) container, or any similar container. The mobile aspect of embodiments of the invention is not limited to providing or coupling such housings or containers with wheels. A mobile unit can be an open or closed housing/container and can be provided with no walls, such as a flatbed or trailer, although housings/containers with walls may be desirable in certain applications to protect the natural gas liquefaction system, the gas cleanup component, and/or the electrical distribution/generator component from the elements/weather. The mobile unit is mobile by virtue of being transportable to a location for use. The mobile unit(s) can be transported in whole or part to a desired location and assembled for use at the location. The mobile unit(s) can be temporarily or permanently fixed at the location once transported there, such as being bolted to concrete slabs. In embodiments, there is no requirement that the mobile unit(s)

remain mobile throughout use of the equipment at the site or that the mobile unit(s) become mobile after use at the site.

In other mobile natural gas liquefaction system implementations including any preceding implementation, the first mobile unit, the second mobile unit, and the third mobile unit are vessels.

These and other implementations will be further described in the foregoing Detailed Description.

BRIEF DESCRIPTION OF THE DRAWINGS

The accompanying drawings illustrate certain aspects of implementations of the present disclosure, and should not be construed as limiting. Together with the written description the drawings serve to explain certain principles of the disclosure.

DETAILED DESCRIPTION

Figure 1:
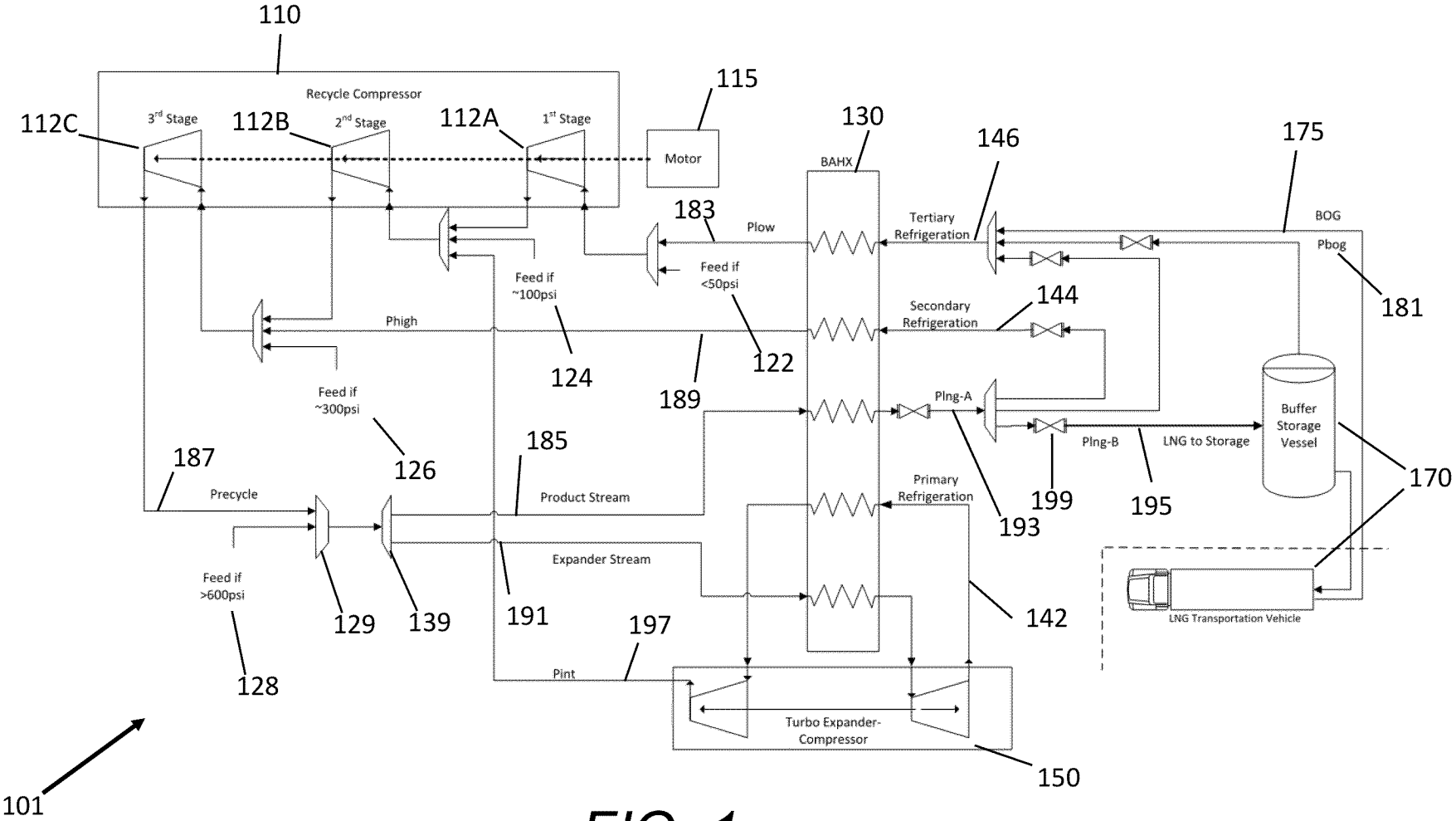
FIG. 1 is a diagram showing an implementation of a system and process for natural gas processing, liquefaction, and storage.

Reference will now be made in detail to various exemplary implementations of the disclosure. It is to be understood that the following discussion of exemplary implementations is not intended to be limiting. Rather, the following discussion is provided to give the reader a more detailed understanding of certain aspects and features of the disclosure.

Aspects of embodiments of the invention include Aspect 1, which is a process comprising: providing a raw natural feed gas to a gas cleanup system and removing one or more impurities from the raw natural feed gas to produce an incoming gas stream; delivering the incoming gas stream to one of multiple gas inlet options of a gas liquefaction system, depending on pressure of the incoming gas stream, and by way of the gas liquefaction system: cooling the incoming gas stream to a cryogenic liquid storage temperature by way of a refrigeration system comprising primary, secondary, and tertiary refrigeration streams; increasing the refrigeration streams to a desired pressure ($P_{recycle}$); and recycling the refrigeration streams through the refrigeration system until a desired cryogenic liquid storage temperature is reached.

Aspect 2 is the process of Aspect 1, wherein the gas liquefaction system is disposed on one or more first mobile unit, the gas cleanup system is disposed on one or more second mobile unit, and/or electrical power equipment for operating the gas liquefaction system and/or the gas cleanup system is disposed on one or more third mobile unit.

Aspect 3 is the process of Aspect 1 or 2, further comprising splitting the incoming gas stream to form a first stream which provides the primary refrigeration stream and a second stream which provides a product stream, which product stream provides the secondary refrigeration stream and the tertiary refrigeration stream.

Aspect 4 is the process of any of Aspects 1-3, further comprising monitoring one or more of flow rate, flow volume, gas temperature, gas composition or gas pressure, and adjusting a flow rate, flow volume, and/or flow ratio within and/or among one or more of the incoming gas stream, the first stream, the second stream, the product stream, the primary refrigeration stream, the secondary refrigeration stream, and/or the tertiary refrigeration stream based on the monitoring.

Aspect 5 is the process of any of Aspects 1-4, further comprising directing the first stream through a heat exchanger and then a turbo-expander to form the primary refrigeration stream.

Aspect 6 is the process of any of Aspects 1-5, wherein the refrigeration system comprises one or more heat exchanger or system.

Aspect 7 is the process of any of Aspects 1-6, further comprising, after leaving the refrigeration system, mixing one or more of the refrigeration streams with incoming gas, before increasing the pressure of the refrigeration streams to $P_{recycle}$ pressure, or mixing the incoming gas optionally at the $P_{recycle}$ pressure.

Aspect 8 is the process of any of Aspects 1-7, wherein increasing the pressure of the refrigeration streams is performed by: a 3-stage compressor with three compressors sharing the same shaft, or three standalone compressors, or a first compressor comprising a first compression stage on a first shaft, and a second compressor comprising second and third compression stages sharing a second shaft; or a first compressor comprising first and second compression stages sharing a first shaft, and a second compressor comprising a third compression stage on a second shaft.

Aspect 9 is the process of any of Aspects 1-8, further comprising expanding, decreasing the pressure, and/or further cooling the incoming gas stream by way of one or more Joule-Thompson valves to form a liquefied natural gas (LNG) product, the secondary refrigeration stream, and the tertiary refrigeration stream.

Aspect 10 is the process of any of Aspects 1-9, further comprising after passing through the Joule-Thompson valve(s), providing: i) a first stream that is an LNG to storage stream; ii) a second stream that mixes with boil off gas from storage to form the tertiary refrigeration stream; and iii) a third stream that results in the secondary refrigeration stream or is split to result in the secondary refrigeration stream and a stream that contributes to the tertiary refrigeration stream.

Aspect 11 is the process of any of Aspects 1-10, wherein the third stream is split and: i) a portion of the split stream, a vapor phase, mixes with the second stream and is subsequently compressed; and iii) a portion of the split stream, a liquid phase, forms the secondary refrigeration stream and is pumped pressure higher than $P_{recycle}$ and compression is not required before recycling back into the product stream.

Aspect 12 is the process of any of Aspects 1-11, wherein once a desired cryogenic liquid storage temperature is reached, delivering resultant liquefied natural gas product to storage.

Aspect 13 is a mobile natural gas liquefaction system comprising: one or more first mobile unit housing gas liquefaction equipment; one or more second mobile unit housing gas cleanup equipment; and one or more third mobile unit housing electrical power equipment; wherein the second mobile unit is capable of a fluid communication with the first mobile unit and/or third mobile unit which allows transfer of a gas supply thereto and wherein the first mobile unit is capable of a fluid communication with the third mobile unit which allows transfer of fuel gas from the first mobile unit to the third mobile unit; and wherein the first mobile unit comprises an output for delivering liquefied natural gas to cryogenic liquid storage.

Aspect 14 is the mobile natural gas liquefaction system of Aspect 13, wherein the gas liquefaction equipment is configured to and capable of performing the process of claim 1.

Aspect 15 is the mobile natural gas liquefaction system of Aspect 13 or 14, wherein the gas liquefaction equipment is capable of liquefaction of gas supplied from the second mobile unit.

Aspect 16 is the mobile natural gas liquefaction system of any of Aspects 13-15, wherein: the electrical power supply is capable of powering the gas liquefaction equipment and/or the gas cleanup equipment; and the electrical power equipment of the third mobile unit comprises an electrical generator capable of using as fuel any one or more of i) gas supplied from the second mobile unit, ii) feed gas, iii) gas from the first mobile unit; and/or any other as fuel gas.

Aspect 17 is the mobile natural gas liquefaction system of any of Aspects 13-16, wherein the first mobile unit housing the gas liquefaction equipment comprises a 3-stage compressor with three compressors sharing the same shaft, or three standalone compressors, or a first compressor comprising a first compression stage on a first shaft and a second compressor comprising second and third compression stages sharing a second shaft, or a first compressor comprising first and second compression stages sharing a first shaft, and a second compressor comprising a third compression stage on a second shaft.

Aspect 18 is the mobile natural gas liquefaction system of any of Aspects 13-17, wherein the second mobile unit comprises: an input designed to receive feed gas to supply the gas cleanup equipment; and one or more output capable of supplying gas to the first mobile unit and/or fuel gas to the third mobile unit.

Aspect 19 is the mobile natural gas liquefaction system of any of Aspects 13-18, wherein the gas cleanup equipment is designed to remove one or more of the following from the feed gas: water, heavy hydrocarbons, BTEX, $H_2S$, Hg. Mercaptans and/or carbon dioxide.

Aspect 20 is the mobile natural gas liquefaction system of any of Aspects 13-19, wherein the first mobile unit, the second mobile unit, and the third mobile unit are each independently chosen from trailers, skids, sea containers, a portable or transportable housing or container, an ISO container, housings or containers with or without wheels, open or closed housings or containers without or with walls, a flatbed, housings or containers that are portable or transportable in whole or part and/or temporarily or permanently fixed at a location for use and/or portable or transportable before, during and/or after use.

Aspect 21 is the mobile natural gas liquefaction system of any of Aspects 13-20. wherein the first mobile unit housing the gas liquefaction equipment is configured for delivering resultant liquefied natural gas product to storage.

Definitions

The following terms are used throughout the disclosure. Other terms should be construed as having their ordinary meaning within the oil and gas engineering arts.

Gas Inlet Options—Clean incoming natural gas is fed into the appropriate location in the process based on inlet gas pressure. Clean gas is substantially free of $H_2O$, $CO_2$, heavy hydrocarbons (C6+), BTEX, Mercaptans, $H_2S$ and Hg.

Recycle Compressor—A single prime mover, single shaft, multi-stage compressor. Gas from various points in the process, at different pressures, is fed into a single compressor at the suction of each stage. The inlet to the first stage is designated as low pressure ($P_{low}$). The gas entering the second stage is designated as intermediate pressure ($P_{int}$). The gas entering the third stage is designated as high pressure ($P_{high}$). Gas exiting the compressor is designated as Recycle pressure ($P_{recycle}$). Other implementations can include 2 stages, or more than 3 stages. The recycle compressor can also be implemented as a system of individual compressors each with its own prime mover or any combination thereof.

Braised Aluminum Heat Exchanger (BAHX)—The main heat exchanger of the refrigeration system of the gas liquefaction systems and processes whose function it is to cool natural gas to cryogenic temperatures. Refrigeration comes from the Primary, Secondary and Tertiary flow paths/refrigeration streams and can be provided by a primary heat exchanger, such as a single heat exchanger (e.g., a braised aluminum heat exchanger (BAHX)) or multiple heat exchangers, such as one or more multiple passage braised aluminum heat exchanger.

Turbo Expander/Compressor—Common Shaft, high speed turbines where the turbo expander rapidly lets down gas pressure and the turbo compressor (driven by the Turbo Expander) increases gas pressure.

Mixer—A single point in the gas liquefaction systems and processes where gas streams are combined at a common pressure.

Joule Thompson (JT) Valve—A special flow control valve used to rapidly expand gas (let down pressure) to provide cooling.

Liquefied Natural Gas (LNG) Storage Tank—Specialized cryogenic storage tank. LNG Storage tank can be an Isometric Container, LNG Trailer, or Stationary Tank. Storage can also be implemented as a plurality of vessels. In some embodiments, storage is not on the liquefaction mobile unit but is a standalone storage facility. In embodiments, the liquefied natural gas (LNG) can be stored in a buffer storage vessel before loading the LNG into subsequent storage or onto a transport truck. The buffer storage vessel can be disposed within a first mobile unit that houses the gas liquefaction equipment or the buffer storage vessel can be a standalone unit. For example, after processing and while waiting for a transport truck to arrive, the LNG can be placed in a buffer storage for temporary storage until the truck arrives where the LNG can be loaded to the transport truck from the buffer storage, if desired.

Boil off Gas (BOG)—Natural gas in vapor phase near cryogenic liquid temperatures. Heat is always being added to the system/storage so BOG is generated as the LNG boils off to vapor. Additionally the portion of the product stream that contains the LNG intended for storage (otherwise referred to as the LNG to Storage Stream) is a two phase stream with up to 15% vapor. So the process inherently generates vapor going to the storage (e.g., buffer storage and/or an LNG transportation vehicle) which can be returned to the heat exchanger as BOG in any embodiment.

Refrigeration Streams—Provides the necessary cooling to lower the inlet natural gas temperature from close to ambient temperature to cryogenic temperatures low enough to liquify natural gas.

The term "about" or "nominally" in association with a numerical value means that the numerical value can vary plus or minus by 10% or less of the numerical value. The term "about" is used interchangeably with the symbol "~".

Designations such as $P_{low}$, $P_{int}$, $P_{high}$, $P_{recycle}$, $P_{bog}$, and $P_{lng}$ can refer to gas pressures or gas streams having such gas pressures.

Figure 2:
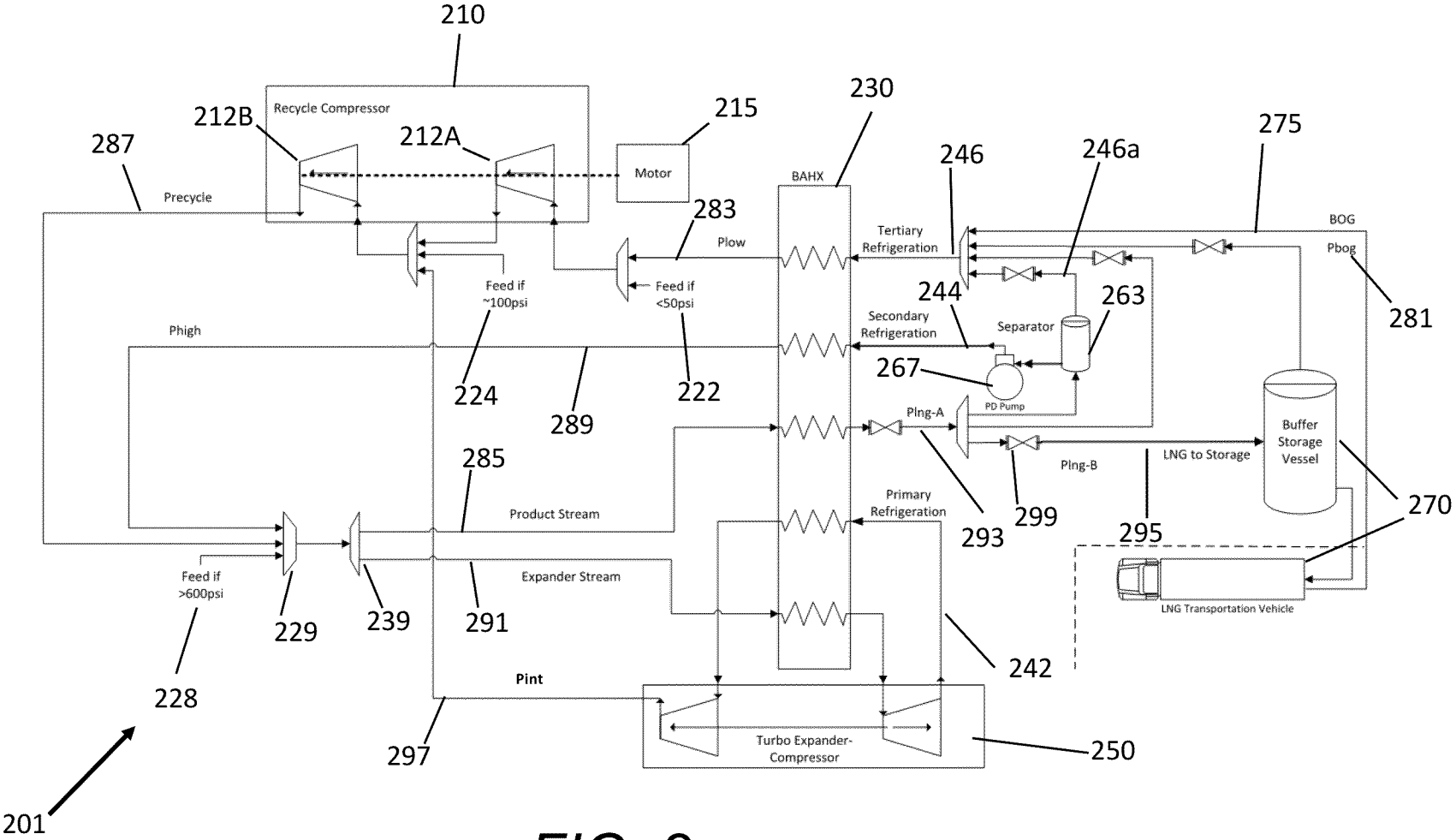
FIG. 2 is a diagram showing another implementation of a system and process for natural gas processing, liquefaction, and storage.

The following table provides the reference numerals used throughout FIGS. 1 and 2 and the features they refer to (note that some features appear in multiple instances and are not repeatedly labeled with reference numerals for simplicity and clarity):

TABLE 1

| Reference Numeral | Feature |
|---|---|
| 101, 201 | Natural Gas Liquefaction System/Process |
| 110, 210 | Recycle Compressor or System |
| 112A-112C, 212A-212B | Individual Stages or Compressors |
| 115, 215 | Motor |
| 122, 222 | Feed if <50 psi |
| 124, 224 | Feed if ~100 psi |
| 126 | Feed if ~300 psi |
| 128, 228 | Feed if >600 psi |
| 129, 229 | Mixer (multiple, not all labeled) |
| 130, 230 | Heat Exchanger |
| 139, 239 | Stream Splitter (multiple, not all labeled) |
| 142, 242 | Primary Refrigeration |
| 144, 244 | Secondary Refrigeration |
| 146, 246, | Tertiary Refrigeration |
| 150, 250 | Turbo Expander-Compressor |
| 170, 270 | Liquefied Natural Gas (LNG) Storage |
| 175, 275 | Boil Off Gas |
| 181, 281 | Boil Off Gas Pressure ($P_{bog}$) |
| 183, 283 | Low Pressure ($P_{low}$) Stream |
| 185, 285 | Product Stream |
| 187, 287 | Compressed Input or Recycle Pressure ($P_{recycle}$) Stream |
| 189, 289 | High Pressure ($P_{high}$) Secondary Refrigeration Stream |
| 191, 291 | Expander Stream |
| 193, 293 | Reduced Pressure Stream A ($P_{lng}$-A) |
| 195, 295 | Reduced Pressure Stream B ($P_{lng}$-B), LNG |
| 197, 297 | Intermediate Pressure ($P_{int}$) Stream |
| 199, 299 | Joule-Thompson Valve (multiple, not all labeled) |
| 246a | Gas Phase from Separator 263 |
| 263 | Separator Vessel |
| 267 | Positive Displacement Pump |

The system and process implementations shown in FIGS. 1 and 2 can include one or more Control Valves (not shown) at any point in the diagrams that are capable of adjusting flow rates or ratios at any point in the system or process. Further, the drawings provided are merely intended to show exemplary implementations; other configurations not shown may also fall within the scope of the disclosure including different arrangements of features and different flow processes.

Components and features used in system and process implementations shown in the drawings and their physical implementation and arrangement can be chosen according to the judgement of an oil and gas engineer or similar artisan. Natural gas compressors can be implemented through selection of those known in the art such as those that operate by positive displacement; these include lobe, screw, liquid ring, scroll and vane type gas compressors all of which are rotary-type gas compressors, and diaphragm, double acting and single acting gas compressors all of which are reciprocating type gas compressors. Dynamic type gas compressors such as centrifugal gas compressors and axial flow gas compressors are also known. Further, compressors can be constant speed compressors or variable speed compressors. Similarly, heat exchangers such as countercurrent flow heat exchangers composed of aluminum plates and fins as well as turboexpanders/compressors useful for gas liquefaction are known and need not be detailed here. Flow processes can be implemented through any suitable pipe, such as metal piping, used for transferring natural gas such as black steel, galvanized steel, copper, brass or corrugated stainless steel tubing. Polyvinyl chloride (PVC) and polyethylene (PE) can be used for pipes buried outside a plant, which may be useful for implementing transfer to plant inlets and outlets.

Operations and processes described or depicted herein can be implemented or assisted through one or more computer processor. Implementations can include a non-transitory computer readable storage medium comprising one or more computer files comprising a set of computer-executable instructions for performing one or more of the processes and operations described herein and/or depicted in the drawings. In exemplary implementations, the files may be stored contiguously or non-contiguously on the computer-readable medium. Further, implementations include a computer program product comprising the computer files, either in the form of the computer-readable medium comprising the computer files and, optionally, made available to a consumer through packaging, or alternatively stored on cloud computing storage on one or more server and made available to a consumer through electronic distribution. As used herein, a "computer-readable medium" includes any kind of computer memory such as floppy disks, conventional hard disks, CD-ROMS, Flash ROMS, non-volatile ROM, electrically erasable programmable read-only memory (EEPROM), and RAM.

As used herein, the terms "computer-executable instructions", "code", "software", "program", "application", "software code", "computer readable code", "software module", "module" and "software program" are used interchangeably to mean software instructions that are executable by a processor. The computer-executable instructions may be organized into routines, subroutines, procedures, objects, methods, functions, or any other organization of computer-executable instructions that is known or becomes known to a skilled artisan in light of this disclosure, where the computer-executable instructions are configured to direct a computer or other data processing device to perform one or more of the specified processes and operations described herein. The computer-executable instructions may be written in any suitable programming language, non-limiting examples of which include C, C++, C#, Objective C, Swift, Ruby/Ruby on Rails, Visual Basic, Java, Python, Perl, PHP, and JavaScript.

In other implementations, files comprising the set of computer-executable instructions may be stored in computer-readable memory on a single computer or distributed across multiple computers. A skilled artisan will further appreciate, in light of this disclosure, how various implementations can include, in addition to software, using hardware or firmware. As such, as used herein, the operations can be implemented in a system comprising any combination of software, hardware, or firmware.

Implementations can include one or more computers or devices loaded with a set of the computer-executable instructions described herein. The computers or devices may be a general-purpose computer, a special-purpose computer, or other programmable data processing apparatus to produce a particular machine, such that the one or more computers or devices are instructed and configured to carry out the processes and operations described herein. The computer or device performing the specified processes and operations may comprise at least one processing element such as a central processing unit (i.e. processor) and a form of computer-readable memory which may include random-access memory (RAM) or read-only memory (ROM). The computer-executable instructions can be embedded in computer hardware or stored in the computer-readable memory such that the computer or device may be directed to perform one or more of the processes and operations depicted in the drawings and/or described herein.

An exemplary implementation includes a single computer or device (e.g. desktop, laptop, tablet, smartphone) that may be configured at a stationary gas liquefaction plant or mobile gas liquefaction system to serve as a controller. The controller may comprise at least one processor. a form of computer-readable memory, and a set of computer-executable instructions for performing one or more of the processes and operations described and/or depicted herein. The single computer or device may be configured at a gas liquefaction plant or mobile system to serve as a controller which sends commands to motors controlling one or more Control Valves to direct or control the flow of gas including rate, volume, and direction in accordance with one or more processes and operations described herein. For example, motors controlling the Control Valves may be connected to the controller by any suitable network protocol, including TCP, IP, UDP, or ICMP, as well any suitable wired or wireless network including any local area network, Internet network, telecommunications network, Wi-Fi enabled network, or Bluetooth enabled network. The controller may be configured at the gas liquefaction plant or mobile system to control opening and closing of the Control Valves based on inputs received from one or more sensors installed within the plant or mobile system. The one or more sensors are capable of measuring or monitoring one or more gas characteristics selected from a gas pressure, temperature, flow rate, and flow volume, and can be installed in various inlets, outlets, or other conduits within the stationary plant or mobile system, or within plant or system equipment. The one or more sensors can send data to the controller through a wired or wireless connection. The controller may also allow an operator to directly control processes at the gas liquefaction plant or mobile system through opening and closing of the Control Valves through an operator interface which may be a graphical user interface (GUI) which may be presented as an HTTP webpage that may be accessed by the operator at a remote general purpose computer with a processor, computer-readable memory, and standard I/O interfaces such as a universal serial bus (USB) port and a serial port, a disk drive, a CD-ROM drive, and/or one or more user interface devices including a display, keyboard, keypad, mouse, control panel, touch screen display, microphone, etc. for interacting with the controller through the GUI.

Systems and processes depicted in the following figures and described herein are implemented to utilize natural gas (e.g. primarily methane) for refrigeration and cooling of a natural gas product stream to cryogenic liquid storage temperature by controlling the rates of three independent cooling or refrigeration streams (Primary, Secondary and Tertiary) as described below. As will be elaborated below, a single recycle compressor with multiple stages with a dedicated suction at each stage provides for multiple inlets or inputs with different properties, such as different pressures. In some implementations, multiple compressors can be arranged together such as serially to accomplish the function of the recycle compressor. The systems and processes can be implemented in a manner that allows for inlet gas to enter at different locations of the system or stages of the process, depending on the inlet pressure, without changing the process. Implementations can include sensors installed within the systems and processes which monitor one or more gas characteristics selected from a flow rate, a flow volume, a gas temperature, and a gas pressure and help control product temperature by adjusting control valves to vary a flow rate, flow volume, and/or flow ratio within or among one or more gas streams, including but not limited to a natural gas product stream, the primary refrigeration stream, the secondary refrigeration stream, and/or the tertiary refrigeration stream; such refrigeration streams can flow through a five-pass heat exchanger counter-currently to the product stream to control product temperature.

Systems and processes depicted and described herein can be implemented at a stationary natural gas liquefaction plant or through a mobile system, such as a system of trailers or vessels. A mobile natural gas liquefaction system can be implemented that provides all necessary functions on three trailers such as double dropdeck trailers, where gas cleanup is accomplished on a Gas Cleanup Trailer (GCT), liquefaction on a Liquefaction and Compression Trailer (LCT), and electrical power and distribution on an Electrical Distribution Trailer (EDT). The refrigeration gas in the mobile system is primarily methane. Gas clean up functions performed by the GCT can include removing one or more of water, heavy hydrocarbons, $H_2S$, BTEX, Mercaptans, Hg, and/or carbon dioxide; all impurities or a subset of them as needed; from the feed gas to produce an incoming gas stream for the LCT, such as removal of substantially all $H_2O$, $CO_2$, heavy hydrocarbons (C6+), BTEX, Mercaptans, $H_2S$ and/or Hg. The liquefaction and compression functions performed by the LCT cool the natural gas to cryogenic temperatures, with necessary compression/recompression of refrigeration gas performed by onboard compressors.

FIGS. 1 and 2 show implementations of a system and process, incorporated or implemented in a stationary gas liquefaction plant or mobile gas liquefaction system, useful for natural gas processing, liquefaction, and storage; the combination of features of the system and process and their arrangement provide unique flexibility for providing multiple gas inlet options at different pressures and liquefaction of the inputted gas. According to the system and process implementations shown in FIGS. 1 and 2, a natural gas liquefaction system and process 101, and alternative natural gas liquefaction system and process 201, both utilizing clean natural gas (NG) as a refrigeration medium substantially free of impurities (e.g. $H_2O$, $CO_2$, heavy hydrocarbons (C6+), BTEX, Mercaptans, $H_2S$, Hg, water, etc.) are shown. The systems and process allow for feed gas to be fed into the system at multiple locations, each feed gas differing in pressure, temperature, or other characteristic. As shown in the figures, each system and process implementation features a recycle compressor (which can also be a system of individual compressors) 110, 210 designed or configured to receive gasses having different characteristics such as different pressures and compress gasses in stages (and/or serially, if implemented as a system of individually compressors) to incrementally boost pressure at each stage. As such, the systems and processes are designed such that feed gas can enter the process at any compressor or compressor stage suction pressure ($P_{low}$, 183, $P_{int}$, 197, or $P_{high}$, 189) or recycle pressure ($P_{recycle}$, 187). As will be further shown, a majority of the feed gas that enters the liquefaction process is liquefied.

Recycle compressor can be configured as two stages 212A and 212B (FIG. 2), three stages 112A-112C (FIG. 1), or can include four, five, six, or more stages, coupled together and driven by a common motor 115, 215, or can include any number of compressors as a compressor system. The recycle compressor 110, 220, or system of compressors advantageously accepts multiple feed streams of gasses, with a low pressure feed accepted at the first stage or compressor, and incrementally higher pressures accepted at later stages. As shown in FIGS. 1 and 2, the recycle compressor (or compressor system) allows multiple feeds to enter, with a low pressure feed (of about <50 psi) entering first stage 112A, 212A at 122, 222, an intermediate pressure feed (~100 psi) entering the second stage 112B at 124, 224, and a higher pressure feed (~300 psi) entering the third stage 112C at 126. Gas exiting the recycle compressor 110, 210 or system has the highest pressure, a compressed input or recycle ($P_{recycle}$) stream 187, 287 that can enter with other high pressure feeds (>600 psi) feeds at 128, 228 to be fed into the refrigeration system. In embodiments, during processing/treatment the incoming gas is fed into a single inlet depending on the pressure of the incoming gas, such as through a first inlet (of about <50 psi), or a second inlet (~100 psi), or a third inlet (~300 psi), or a fourth inlet (>600 psi). Mixers such as the mixer shown at 129, 229 and elsewhere allow for mixing of feed gas 128, 228 with the compressed input or recycle ($P_{recycle}$) stream 187, 287; or allow for mixing of feed gasses 122, 222; 124, 224; 126 with recycled refrigeration streams and/or outputs of compressor or compressor stages 112A-C, 212A-B.

After mixing compressed input or recycle ($P_{recycle}$) stream at 187, 287, stream splitter 139, 239 splits gas into product stream 185, 285, and expander stream 191, 291. Product stream and expander stream enter heat exchanger 130, 230, such as a Braised Aluminum Heat Exchanger (BAHX), which can be a single heat exchanger or multiple heat exchangers, such as one or more multiple passage braised aluminum heat exchanger or a heat exchanger system with a plurality of heat exchangers. Gas in the product stream 185, 285 enters the liquefaction process at a given recycle pressure ($P_{recycle}$-nominally ~600 psig close to ambient temperature). Refrigeration is accomplished by way of three cooling streams (primary, secondary and tertiary) with adjustable flow rates and flow volumes. Expander stream 191, 291 enters heat exchanger 130, 230 where the temperature of the stream is lowered, then enters turbo expander 150, 250, from which exits a primary refrigeration stream 142, 242 which enters heat exchanger 130, 230. The primary refrigeration stream 142, 242 provides cooling by rapid expansion of feed natural gas at $P_{recycle}$ conditions via the turbo expander to lower pressure (nominal ~50 psi). The primary refrigeration stream provides most of the cooling. The gas in the primary refrigeration stream 142, 242 enters the heat exchanger at about13 150° F. to −180° F. and exits the heat exchanger at a higher temperature (i.e., the primary refrigeration stream (and any refrigeration stream) adds cooling or refrigeration to the system when treated by the heat cxchanger). Primary refrigeration stream exits heat exchanger and enters turbo compressor 150, 250, which raises the pressure to an intermediate pressure 197, 297 ($P_{int}$ nominally ~90 psi). The turbo compressor is driven by the common shaft connected to the turbo expander. The intermediate pressure stream 197, 297 is directed back to compressor 110, 210 or compressors for recycling, such that gas from the turbo compressor is fed into the suction of the recycle compressor's 110, 210 second stage 112B, 212B. A flow ratio between product stream 185, 285 and expander stream 191, 291 is adjusted dependent on gas composition or characteristics to achieve maximum efficiency.

Product stream 185, 285 enters heat exchanger at close to ambient temperature. The gas in this product stream can be cooled within the heat exchanger from ambient to close to about −225° F. This stream is directed through one or more Joule-Thompson valves 199, 299 to provide reduced pressure stream A 193, 293, which can be nominally ~250 psig and ~−225° F., which is split to provide secondary 144, 244 and tertiary 146, 246 refrigeration streams, and/or an LNG to storage stream. The secondary refrigeration stream 144, 244 is a slip stream of the liquefied natural gas product stream 185, 285, which at this point is a reduced pressure stream 193, 293. A control valve in the secondary refrigeration stream throttles the flowrate in this stream to control the desired cooling contribution. The secondary refrigeration stream 144, 244 enters the heat exchanger at about −225° F. Pressure drop in this stream is minimal, such that upon exiting the heat exchanger, the secondary refrigeration stream 144, 244 is warmed (cooling added to the system from the secondary refrigeration stream) and is high-pressure secondary refrigeration stream at points 189, 289, and the gas can enter the suction of the third stage of the recycle compressor 112C at this high pressure (typically about 230 psi). The tertiary refrigeration stream 146, 246 is a combination of the boil off gas 175, 275 coming from the liquefied natural gas storage tank and/or transportation vehicle 170, 270 and a slip stream from the liquefied natural gas (LNG) product steam. The gas in the tertiary refrigeration stream 146, 246 enters the heat exchanger at about a temperature of −235° F. and exits the heat exchanger at a warmer temperature close to the temperature of the product stream entering the heat exchanger. Boil off gas 175, 275 coming from the LNG storage tank and/or transportation vehicle is at pressure $P_{bog}$ 181, 281 and temperature close to the liquid in the liquefied natural gas (LNG) storage tank and/or transportation vehicle 170, 270. The slip steam pressure is reduced from $P_{lng}$-A 193 to $P_{bog}$ 181 (nominal ~80 psig to ~25 psig) where it is mixed with the boil off gas 175, 275 coming from the liquefied natural gas storage tank and/or transportation vehicle 170, 270. The slip stream flow is throttled by a control valve to provide the final step of cooling such that the liquefied natural gas product stream reaches the desired temperature. Secondary and tertiary refrigeration streams that exit heat exchanger 130, 230 can be subsequently mixed with feed gasses by way of mixers. For example, i) low pressure stream 183, 283 can be mixed with feed 122 and then is inputted at first stage 112A, 212A of recycle compressor 110, 210 or system and then ii) the gas exiting first stage 112A, 212A can be mixed with feed 124, or iii) high pressure stream 189, 289 can be mixed with feed 126 and then inputted at third stage 112C. Flow rates, flow volumes, and/or flow ratios within or among one or more gas streams, such as product steam, expander stream, primary refrigeration stream, secondary refrigeration stream, and tertiary refrigeration stream are adjusted on the fly based on sensor input of gas stream characteristics (e.g. flow rate, a flow volume, gas temperature, gas composition, and/or gas pressure) to ensure liquefied natural gas product desired temperature is reached at all desired production volumes. The recycle compressor 110, 210 consolidates all the lower pressure gas within the process and recompresses it back to recycle conditions.

Prior to entering the liquefied natural storage tank and/or transportation vehicle 170, 270 the pressure is further reduced to the desired storage pressure. Reduced pressure stream A ($P_{lng}$-A) 193, 293 can be further reduced in pressure through Joule-Thompson valve 199, 299 to provide reduced pressure stream B ($P_{lng}$-B), a liquefied natural gas stream 195, 295 which is directed to tanks and/or transportation vehicles 170, 270 for storage at a storage pressure of nominally ~5 psig to ~80 psig. The temperature of the liquefied natural gas is about −235° F. at 25 psig which is determined by the saturation pressure of 195, 295. The lower the saturation pressure, the colder the LNG temperature in the storage 170, 270. The process produces a two-phase stream going to the storage, with liquid content ranging from 85-95% where the remainder is still a gas. Boil off gas 175, 275 at boil off gas pressure $P_{bog}$ 181, 281 can be mixed slip stream of reduced pressure stream A 193 to form tertiary refrigeration stream 146, 246.

In the implementation shown in FIG. 2, a slip stream of the liquefied natural gas product stream 285, now reduced pressure stream 293, is directed to a separator vessel 263 to separate the two phases of natural gas (liquid and vapor). The liquid from the separator vessels 263 supplies a positive displacement pump 267 that provides motive force to pump the liquid into the heat exchanger 230. The discharge pressure of the positive displacement pump 267 will be higher than the incoming recycle gas pressure 287 ($P_{recycle}$). Within the heat exchanger 230 the liquid can provide refrigeration and change phase to a gas. The recycle pump's drive motor can run on a variable frequency electrical drive so that the refrigeration can be accurately controlled. Gas from the separator vessel 263 can be directed to the tertiary refrigeration system 246 by way of stream 246*a*, which is then mixed with BOG 275 from storage 270 to form tertiary refrigeration stream 246.

Figure 3:
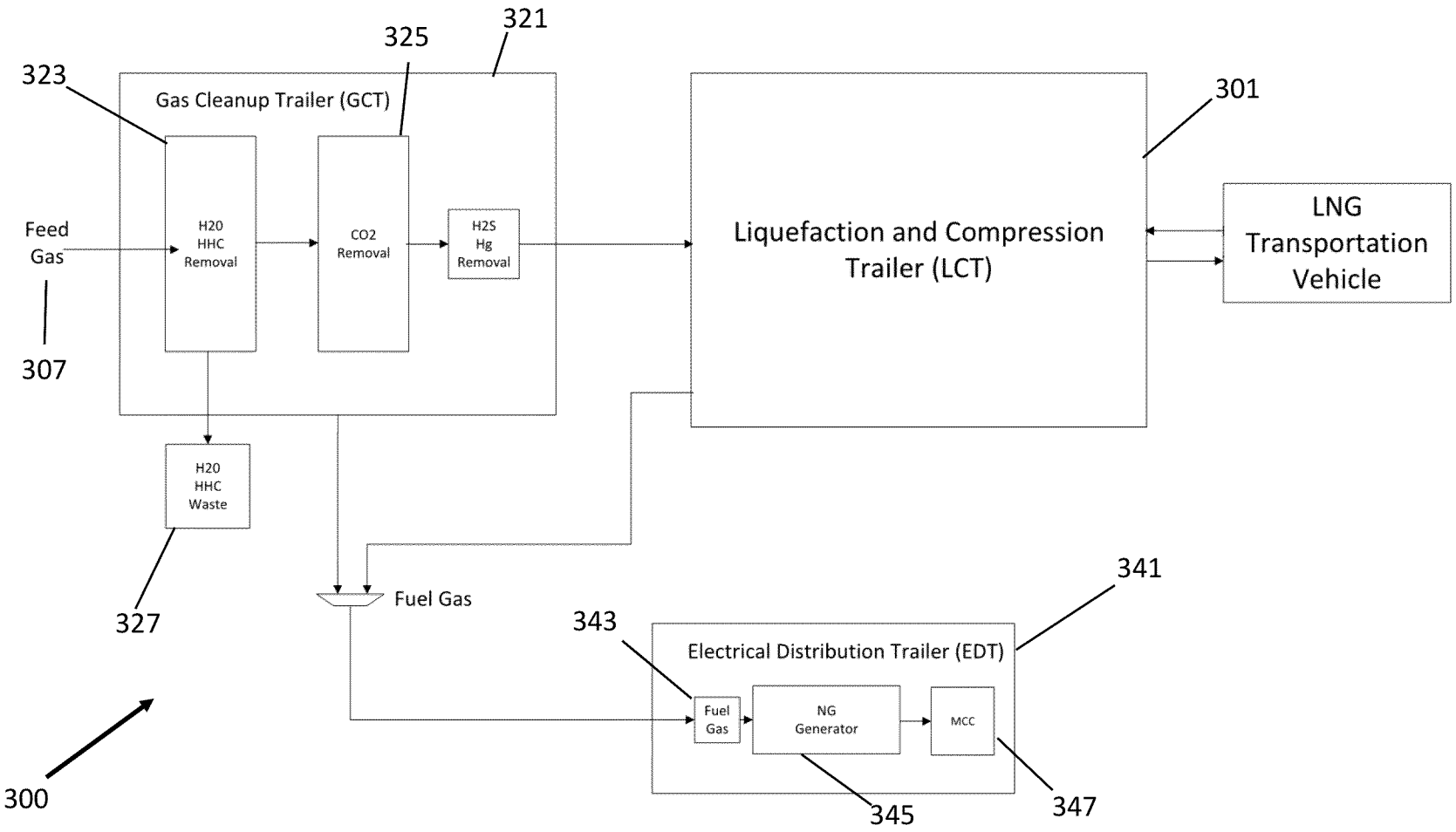
FIG. 3 is a diagram showing an implementation of a mobile system and process for natural gas processing, liquefaction, and storage.

FIG. 3 depicts a mobile system 300 for onsite cleanup and liquefaction of natural gas. The mobile system 300 can be implemented on a system of mobile units, including trailers such as double dropdeck trailers (tractor trailers) as shown, for natural gas sites on land, or alternatively, boats or other vessels for those at sea. Shown is a mobile natural gas liquefaction system and process akin to those previously described implemented on a mobile liquefaction and compression trailer (LCT) 301, as part of the mobile system 300. The LCT 301 can include the same components and processes depicted in FIGS. 1 and 2 and/or can be combined with one or more mobile units having the same, similar, different or additional functions. The mobile system 300 can include, in addition to one or more LCT 301, one or more gas cleanup trailer (GCT) 321. The GCT(s) 321 include an input in which raw natural gas 307 (feed gas) enters. Cleanup equipment for removing water and heavy hydrocarbons 323 and carbon dioxide 325 as well as other constituents such as $H_2S$ and Hg remove contaminants as waste 327. The GCT(s) 321 supply cleaned gas to enter the LCT(s) 301 for liquefaction. The mobile system can include one or more electrical distribution trailer (EDT) 341 which can receive fuel gas or cleaned fuel gas 343 from the GCT(s) 321 and/or fuel gas or cleaned fuel gas from the LCT(s) 301. Alternatively or in addition, feed gas can be supplied (indirectly or directly) to the EDT(s) 341 with or without first passing through GCT(s) 321 and/or LCT(s) 301. The GCT(s) 321 can supply the LCT(s) 301 with cleaned gas through piping set up between the trailers at natural gas sites. The fuel gas 343 can power one or more generators 345, which is in communication with an electrical substation, or e-house 347 on the EDT(s) 341 containing power equipment. Operative electrical connections between the EDT(s) 341 and other trailers can supply electrical power from the generator(s) 345 to cleanup equipment 323 and 325 on the GCT(s) 321 and liquefaction equipment on the LCT(s) 301. The LCT(s) 301 can be configured to supply the processed/treated liquefied natural gas to one or more storage options, such as an on-board and/or separate storage tank or one or more LNG transportation vehicles, and configured to receive any boil off gas (BOG) from such storage options (as indicated by arrows between LCT 301 and the storage or LNG transportation vehicle). The mobile system 300 allows for on-site cleanup, processing, and storage of natural gas in an energy efficient manner.

Modifications of the implementations shown in FIGS. 1-3, including substitutions, additions, rearrangements, and/or deletions of features, which modified implementations achieve substantially the same functional result, are also contemplated.

The present disclosure has included reference to particular implementations having various features. In light of the disclosure provided above, it will be apparent to those skilled in the art that various modifications and variations can be made without departing from the scope or spirit of the disclosure. One skilled in the art will recognize that the disclosed features may be used singularly, in any combination, or omitted based on the requirements and specifications of a given application or design. When an implementation refers to "comprising" certain features, it is to be understood that the implementations can alternatively "consist of" or "consist essentially of" any one or more of the features. Other implementations will be apparent to those skilled in the art from consideration of the specification and drawings.

It is noted in particular that where a range of values is provided in this specification, each value between the upper and lower limits of that range is also specifically disclosed. The upper and lower limits of these smaller ranges may independently be included or excluded in the range as well. The singular forms "a," "an," and "the" include plural referents unless the context clearly dictates otherwise. It is intended that the specification and examples be considered as exemplary in nature and that variations that do not depart from the essence of the disclosure fall within the scope of the disclosure. Further, all of the references cited in this disclosure are each individually incorporated by reference herein in their entireties and as such are intended to provide an efficient way of supplementing the enabling disclosure as well as provide background detailing the level of ordinary skill in the art.

The invention claimed is:

1. A mobile natural gas liquefaction system comprising:

one or more first mobile unit housing gas liquefaction equipment and a refrigeration system comprising primary, secondary, and tertiary refrigeration streams;

one or more second mobile unit housing gas cleanup equipment; and one or more third mobile unit housing electrical power equipment;

wherein the one or more second mobile unit is capable of fluid communication with the one or more first mobile unit in a manner to provide an incoming gas stream for the one or more first mobile unit and optionally capable of fluid communication with the one or more third mobile unit which allows transfer of gas supply thereto and wherein the one or more first mobile unit is capable of fluid communication with the one or more third mobile unit which allows transfer of fuel gas from the one or more first mobile unit to the one or more third mobile unit;

wherein the one or more first mobile unit is configured to deliver the incoming gas stream to a single compressor inlet chosen from one of multiple compressor inlets depending on the pressure of the incoming gas stream;

wherein the multiple compressor inlets comprise:

at least one first compressor inlet configured to receive the incoming gas stream at a first inlet pressure and configured to receive the primary refrigeration stream;

at least one second gas input compressor inlet configured to receive the incoming gas stream at a second inlet pressure that is different from the first inlet pressure and configured to receive the secondary refrigeration stream;

at least one third compressor inlet configured to receive the incoming gas stream at a third inlet pressure that is different from the second inlet pressure and configured to receive the tertiary refrigeration stream; and at least one fourth compressor inlet configured to receive the incoming gas stream at a fourth inlet pressure that is different from the third inlet pressure and configured to receive the primary refrigeration stream, the secondary refrigeration stream and the tertiary refrigeration stream;

wherein the one or more first mobile unit comprises one or more compressors in a flowpath downstream of the at least one first and second compressor inlets and one or more heat exchanger in the flowpath downstream of the one or more compressors; and wherein the one or more first mobile unit comprises an output for delivering liquefied natural gas to cryogenic liquid storage.

2. The system of claim 1, the gas liquefaction equipment of the one or more first mobile unit comprises:

one or more recycle loops configured to recycle the primary, secondary and tertiary refrigeration streams through the refrigeration system.

3. The system of claim 1, wherein the gas liquefaction equipment of the one or more first mobile unit is capable of liquefaction of the incoming gas stream from the one or more second mobile unit and a gas supply from second source.

4. The system of claim 1, wherein the gas liquefaction equipment of the one or more first mobile unit is configured such that downstream of at least one of the one or more compressors, the flowpath is split into i) the primary refrigeration stream and/or ii) a product stream which is split into the secondary and/or the tertiary refrigeration stream and/or an LNG to storage stream.

5. The system of claim 4, wherein the gas liquefaction equipment of the one or more first mobile unit is configured such that the product stream:

mixes with boil off gas from storage to form the tertiary refrigeration stream; and/or the secondary refrigeration stream is split into a stream that contributes to the tertiary refrigeration stream.

6. The system of claim 1, wherein the gas liquefaction equipment of the one or more first mobile unit comprises as the one or more compressors: wherein the one or more compressors comprises:

a 3-stage compressor with three compressors sharing the same shaft, or three standalone compressors, or a first compressor comprising a first compression stage on a first shaft and a second compressor comprising second and third compression stages sharing a second shaft, or a first compressor comprising first and second compression stages sharing a first shaft, and a second compressor comprising a third compression stage on a second shaft.

7. The mobile natural gas liquefaction system of claim 6, wherein the three standalone compressors include a first stage compressor, a second stage compressor, and a third stage compressor, wherein:

the first stage compressor comprises the first compressor inlet configured to accept the incoming gas at the first inlet pressure;

the second stage compressor comprises the second compressor inlet configured to accept the incoming gas at the second inlet pressure; and the third stage compressor comprises a third compressor inlet configured to accept the incoming gas at a third inlet pressure;

wherein the first inlet pressure is less than the second inlet pressure and the second inlet pressure is less than the third inlet pressure.

8. The system of claim 6, further comprising one or more mixer(s) disposed upstream of and/or downstream of and in a manner to combine one or more feed gas with gas streams entering or exiting, respectively, the first, second, and/or third stage compressor(s).

9. The system of claim 1, wherein:

the one or more third mobile unit is capable of an operative electrical connection with the one or more first mobile unit and/or the one or more second mobile unit which allows transfer of an electrical power supply thereto, wherein the electrical power supply is capable of powering the gas liquefaction equipment and/or the gas cleanup equipment; and the electrical power equipment of the one or more third mobile unit comprises an electrical generator capable of using as fuel any one or more of i) gas supplied from the one or more second mobile unit, ii) feed gas, iii) gas from the one or more first mobile unit; and/or any other as fuel gas.

10. The system of claim 1, wherein the gas cleanup equipment of the one or more second mobile unit is designed to remove from feed gas one or more of: water, heavy hydrocarbons, BTEX, $H_2S$, Hg, Mercaptans and/or carbon dioxide.

11. The system of claim 1, wherein the one or more first mobile unit, the one or more second mobile unit, and the one or more third mobile unit are each independently chosen from trailers, skids, sea containers, a portable or transportable housing or container, an ISO container, housings or containers with or without wheels, open or closed housings or containers without or with walls, a flatbed, housings or containers that are portable or transportable in whole or part and/or temporarily or permanently fixed at a location for use and/or portable or transportable before, during and/or after use.

12. The system of claim 1, wherein the gas liquefaction equipment of the one or more first mobile unit comprises a turbo expander/compressor.

13. The system of claim 12, wherein:

the turbo expander/compressor is disposed on a common shaft and is disposed in a manner to produce the primary refrigeration stream;

such that a turbo expander of the turbo expander/compressor is capable of rapidly letting down gas pressure, while a turbo compressor of the turbo expander/compressor is driven by the turbo expander of the turbo expander/compressor and is capable of increasing gas pressure.

14. The system of claim 13, wherein:

the gas liquefaction equipment of the one or more first mobile unit further comprises a heat exchanger disposed in a manner to receive the primary refrigeration stream from the turbo expander of the turbo expander/compressor and deliver the primary refrigeration stream to the turbo compressor of the turbo expander/compressor.

15. The system of claim 1, wherein the gas liquefaction equipment of the one or more first mobile unit comprises methane (CH4) as refrigeration gas.

* * * * *